US007391176B2

(12) United States Patent
Grehant

(10) Patent No.: US 7,391,176 B2
(45) Date of Patent: Jun. 24, 2008

(54) ACTUATOR FOR OPERATING A ROLLING SHUTTER

(75) Inventor: Bernard Grehant, Nancy-sur-Cluses (FR)

(73) Assignee: Somfy SAS (FR)

( * ) Notice: Subject to any disclaimer, the term of this patent is extended or adjusted under 35 U.S.C. 154(b) by 230 days.

(21) Appl. No.: 11/105,854

(22) Filed: Apr. 14, 2005

(65) Prior Publication Data

US 2005/0237692 A1 Oct. 27, 2005

(30) Foreign Application Priority Data

Apr. 27, 2004 (FR) ..... 04 04449

(51) Int. Cl.

| | |
|---|---|
| ***G05B 5/00*** | (2006.01) |
| ***G05D 3/00*** | (2006.01) |
| ***H02H 7/08*** | (2006.01) |
| ***H02P 1/04*** | (2006.01) |
| ***H02P 3/00*** | (2006.01) |

(52) U.S. Cl. ..... 318/466

(58) Field of Classification Search ..... 318/466
See application file for complete search history.

(56) References Cited

U.S. PATENT DOCUMENTS

| | | | | |
|---|---|---|---|---|
| 5,760,558 | A * | 6/1998 | Popat | 318/480 |
| 6,078,159 | A | 6/2000 | Valente et al. | |
| 6,384,558 | B2 * | 5/2002 | Yoshida et al. | 318/445 |

FOREIGN PATENT DOCUMENTS

| | | |
|---|---|---|
| EP | 0 867 848 A1 | 9/1998 |
| EP | 0 921 507 | 6/1999 |
| FR | 2 761 183 | 9/1998 |
| FR | 2 844 625 | 3/2004 |

* cited by examiner

*Primary Examiner*—Lincoln Donovan
*Assistant Examiner*—Erick Glass
(74) *Attorney, Agent, or Firm*—Welsh & Katz, Ltd.

(57) ABSTRACT

The actuator comprises at least two terminals enabling it to be connected to a voltage source, an electric motor, a control unit) connected to means of powering the motor from the voltage source, the control unit comprising a voltage converter whose output powers a microcontroller driving the means for powering the motor. The control unit comprises a unit for monitoring the power-off time during which the actuator is not connected to the voltage source.

9 Claims, 5 Drawing Sheets

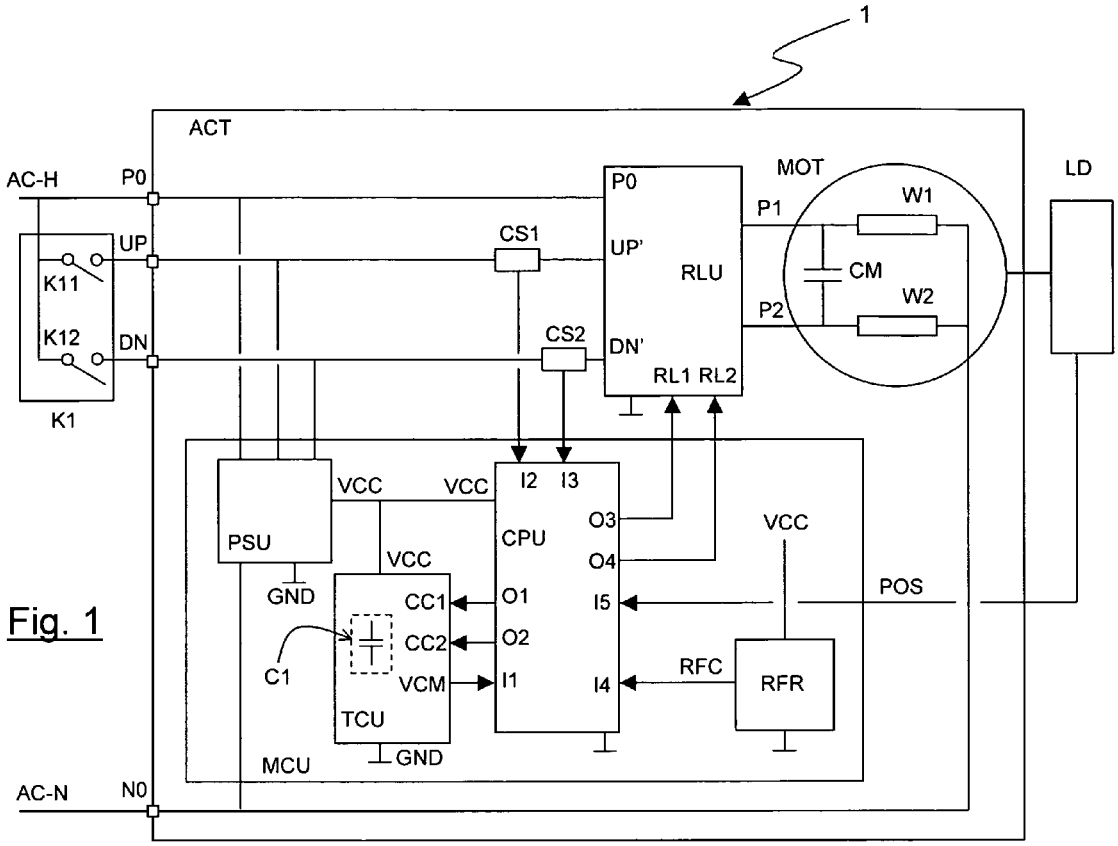
Fig. 1
Fig. 3A
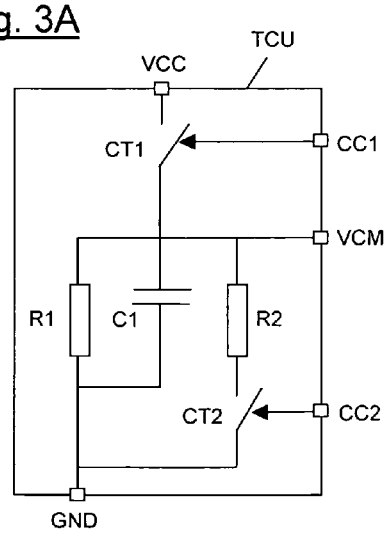
Fig. 3B
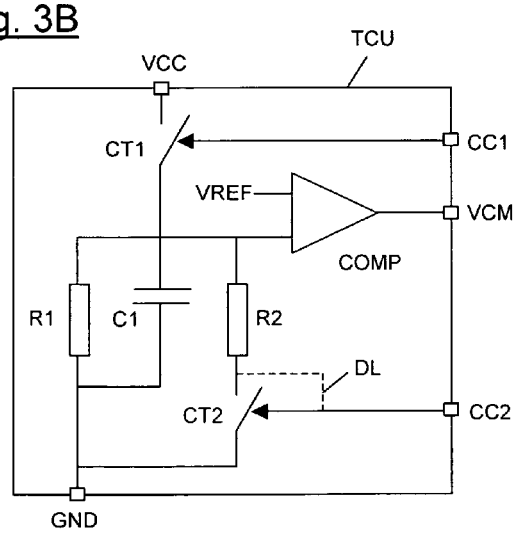

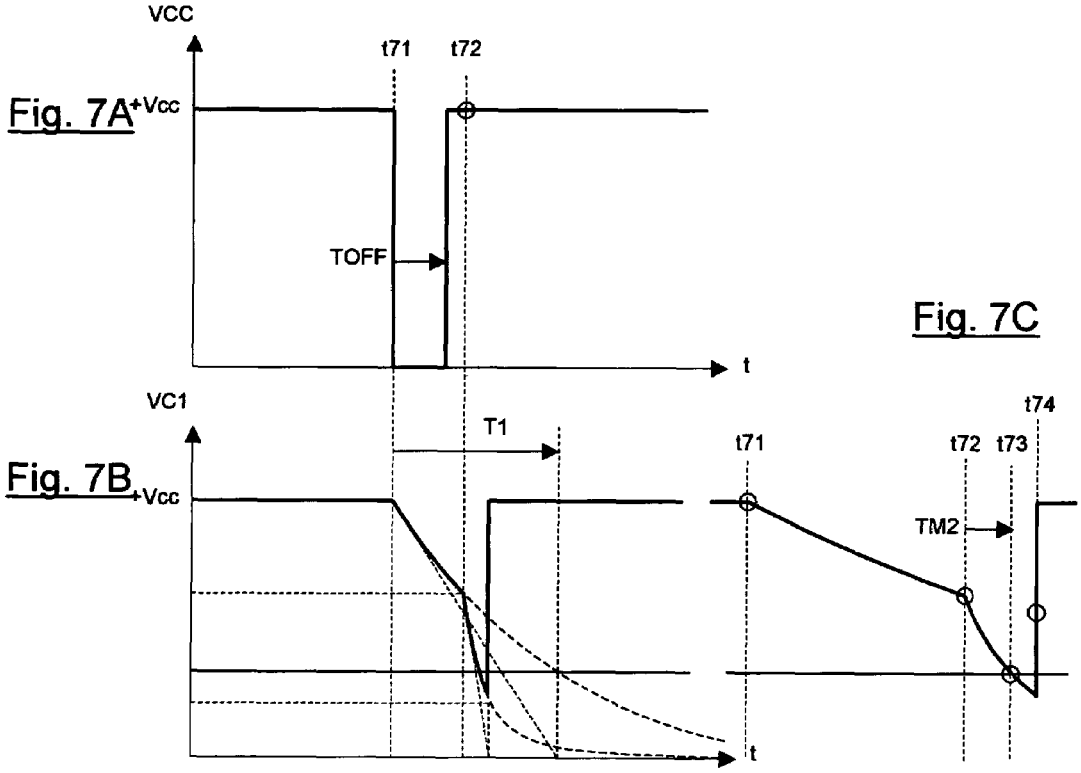
Fig. 7A
Fig. 7B
Fig. 7C
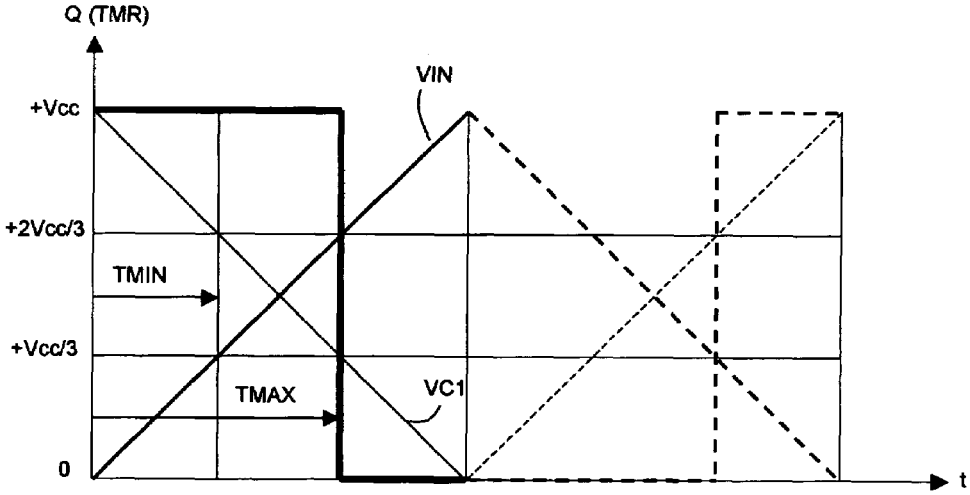
Fig. 8

ACTUATOR FOR OPERATING A ROLLING SHUTTER

FIELD OF THE INVENTION

The invention relates to an actuator for operating a movable screen or a movable object for closure, shading or solar protection of a building. The invention also relates to method for estimating a duration for which such an actuator is not powered.

BACKGROUND OF THE INVENTION

Actuators used for operating elements for closure, shading or solar protection of a building are often powered via the AC electrical energy mains. In certain configurations, it turns out to be very beneficial to measure the time during which the actuator is not powered. Specifically, one or more brief periods of non-powering of the actuator may be used to send the latter a command of a particular type.

These periods of non-powering relate to durations that are in general much longer than those used in modes of control by interrupting a portion of alternation of the alternating power supply, or even of a few alternations as described, for example, in application FR 2 844 625.

The durations of non-powering making it possible to send a command of a particular type are of the order of a second or several seconds.

DESCRIPTION OF THE PRIOR ART

Application FR 2 761 183, the content of which is herein incorporated by reference, discloses the use of a double cutout of the power supply to the actuator so as to cause the internal memories of the actuator to be reset to zero and/or so as to place the actuator in a learning mode.

U.S. Pat. No. 6,078,159, the content of which is herein incorporated by reference, discloses a device for operating a closure element. The device comprises a control box furnished with two buttons making it possible respectively to displace a movable element in a first direction and in a second direction. To place this device in a configuration mode, it is necessary to actuate one or other of the buttons at least twice within a predefined time span that is less than a duration of actuation allowing the control of the movement of the movable element. Thus, when one wishes to displace the movable element, it is necessary to actuate the control button for a duration greater than that of the predefined time span.

In the various cases, it is advisable to make certain that the control pulses follow one another within a brief interval of time. Now, on account of the disappearance of the voltage of the AC mains at the moment of cutout, this measure is not taken. For example, the device which is the subject of U.S. Pat. No. 6,078,159 measures the duration of the control pulses but not the interval of time which separates them.

Without any means making it possible to measure the time during which the power supply has been interrupted, an obvious degradation of safety results. Specifically, the microcontroller will not have the means of distinguishing an intentional brief cutout, having a predetermined duration and repeated for example twice for confirmation, from an accidental cutout of very brief duration or, on the contrary, of very long duration.

The aim of the invention is to provide an actuator making it possible to remedy these drawbacks. In particular, the actuator according to the invention has a very simple and economical structure allowing the determination of a duration for which the actuator is not powered. The invention also proposes a method for estimating the duration for which the actuator is not powered, this method being implemented by such an actuator.

SUMMARY OF THE INVENTION

The invention includes at least two terminals for connecting the actuator to a voltage source, an electric motor, a control unit connected to means of powering the motor from the voltage source, the control unit comprising a voltage converter whose output powers a microcontroller driving the means for powering the motor.

The actuator according to the invention is one in which the control unit comprises a unit for monitoring the power-off time during which the actuator is not connected to the voltage source.

The method of estimation according to the invention is one which may comprise the following steps:

- charging a monitoring capacitor,
- ceasing to power the actuator,
- closing an electrical circuit for discharging the capacitor,
- powering the actuator,
- obtaining an information regarding the voltage across the terminals of the capacitor,
- deducing from this information, at least one limit of the interval in which the duration separating the event of the second step from the event of the fourth step is located.

DESCRIPTION OF THE DRAWINGS

The figures represent, by way of examples, actuators according to the invention which allow the implementation of the method according to the invention.

FIG. 1 is an electrical diagram of an installation comprises a first variant of an actuator according to the invention;

FIGS. 3A, 3B and 4 are electrical diagrams of various embodiments of a unit for monitoring the power-off time of the power supply to an actuator;

FIGS. 5 to 8 are time charts of the variations of different electrical signals explaining the principles of the different variants of execution of the method according to the invention.

DETAILED DESCRIPTION

Figure 2:
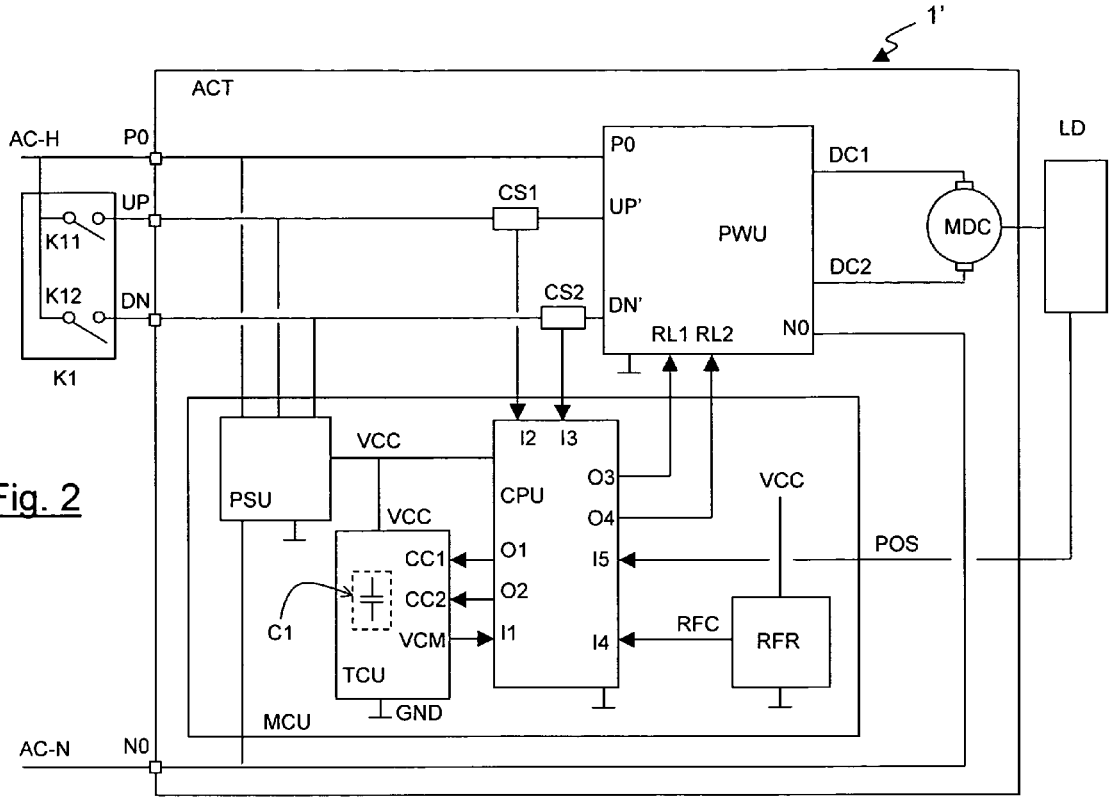
FIG. 2 is an electrical diagram of an installation comprising a second variant of an actuator according to the invention.

The installation 1 represented in FIG. 1 comprises an actuator ACT furnished with a motor MOT driving a movable object attached to the building and called the load LD in a first or a second direction of displacement, for example an up or down direction for a rolling shutter or in a rightward horizontal direction or leftward horizontal direction for a sliding panel. The actuator is linked to the AC power mains, which comprise a neutral conductor AC-N and a phase conductor AC-H. This connection is made at the level of the neutral conductor via a terminal NO. The connection to the phase conductor is effected on the one hand via a permanent phase terminal P0 and, on the other hand, via a first phase terminal UP and a second phase terminal DN, that can both be connected to the phase conductor AC-H according to the state of a control switch K1. In FIG. 1, the control switch comprises two switches K11 and K12, for example push buttons. Depending on whether the user wishes to operate the object in one direction or the other, he presses the switch K11 or the switch K12. A pulse of brief duration may possibly be interpreted as a command to move the load LD until it reaches the end of travel. In this case, the power supply to the motor is permitted by virtue of the presence of the connection of the phase conductor AC-H with a permanent phase terminal P0.

However, certain installations are produced with no permanent link from the phases conductor AC-H to the actuator ACT, or even without this permanent phase terminal P0 existing on the actuator. In this case, the switches K11 and K12 are necessarily activated throughout the duration of the movement, so as to allow the actuator to be powered through one or other of these switches.

The "closed" states of the switches K11 and K12 are detected respectively by a first sensor CS1 and a second sensor CS2, consisting of current sensor devices, optocouplers or simple electronic arrangements allowing the transformation of a high AC voltages into a DC voltage of low enough value to be utilized in a logic manner, for example 5 volts. These sensors are preferably current sensors but it is equally possible to envisage potentiometric dividers with rectifying diode and filter capacitor.

The actuator comprises a control unit MCU comprising a microcontroller CPU, a supply converter PSU and a power-off time monitoring unit TCU which will be detailed hereinbelow and whose measurement output VCM is linked to a first input I1 of the microcontroller CPU.

The supply converter PSU makes it possible to deliver a DC voltage between two output lines VCC and GND. As is customary, the potential of the ground line GND is referenced to 0 and that of the positive line VCC then equals +Vcc, for example +5 volts. This DC potential is applied to various circuits of the control unit MCU so as to power them.

The input of the supply converter PSU is able to be linked to the phase conductor AC-H by way of three wires, which are connected to the permanent phase terminal P, to the first phase terminal UP and to the second phase terminal DN.

Although situated downstream in FIG. 1, the sensors CS1 and CS2 may also be situated upstream of the wires powering the supply converter PSU, that is to say interposed between the UP or DN terminals and the supply wires for the supply converter PSU.

The signals from the sensors CS1 and CS2 are applied to a second input I2 and to a third input I3 of the microcontroller CPU and determine, according to their origin, whether the command applied is a command for operating in the first direction or in the second direction or else whether it results from a combination of presses on the switches K11 and K12 which should be interpreted as a special command.

In the case of an installation communicating remotely with a command transmitter, the commands may also be received by a radio receiver RFR and transmitted to the microcontroller by a serial line RFC applied to a fourth input I4 of the microcontroller CPU.

The microcontroller CPU comprises a first output O1 and a second output O2 that are linked to a power-off time monitoring unit TCU. It also comprises a third output O3 and a fourth output O4 that are linked to a switching unit RLU via a first switching input RL1 and a second switching input RL2.

As a function of the commands received, the microcontroller CPU activates the third output O3 or the fourth output O4 in such a way as to actuate for example relays contained in the switching unit RLU. The relays are of electromagnetic type or of static type. The switching unit allows the connecting of the motor to the phase conductor AC-H, either directly via a link to the permanent phase terminal P0, or through the switch K1 by way of the first phase terminal UP or of the second phase terminal DN through the sensors CS1 or CS2 which entail a negligible voltage drop. Thus the potential of the conductor referenced UP' may be regarded as the potential of the phase terminal UP, and the potential of the conductor referenced DN' may be regarded as the potential of the phase terminal DN.

In the case of FIG. 1, the motor MOT is a single-phase induction motor with permanent phase-shifting capacitor, comprising two coils, W1 and W2 and a capacitor CM. The motor is linked on the one hand to the neutral conductor AC-N, by way of a connection to the neutral terminal N0, and on the other hand to the phase conductor AC-H, by way of the switching unit RLU whose outputs P1 and P2 are linked to the inputs P0, UP', DN' according to the state of the inputs RL1 and RL2 of the switching unit.

A mechanical reduction gear, not represented, may be integrated into the kinematic chain between the electric motor and the movable object to be operated.

A position sensor, not represented, may be integrated into the moveable object and deliver a signal of position of the latter applied to a fifth input I5 of the microcontroller CPU, by a line POS.

The control unit MCU comprises a power-off time monitoring unit TCU powered between the positive line VCC and the ground line GND. It is connected to the first input I1, to the first output O1 and to the second output O2 of the microcontroller CPU.

A first embodiment of the power-off time monitoring unit TCU is represented in FIG. 3A. The unit comprises a monitoring capacitor C1 and two terminals connected to the positive line VCC and to the ground line GND, making it possible to charge the monitoring capacitor under the voltage +Vcc when a first controlled switch CT1 is closed. The control of this switch is effected via a first control terminal CC1, which is connected to the first output O1 of the microcontroller CPU. A first resistor R1 is wired up in parallel with the monitoring capacitor C1 and discharges the monitoring capacitor when the first controlled switch CT1 is open or when the voltage +Vcc disappears on the positive line VCC.

Finally, a measurement output terminal VCM is connected to the common point between the first controlled switch and the monitoring capacitor C1. This terminal therefore allows a measurement of the voltage across the terminals of the capacitor, whether the latter is charged or is discharging.

The first input I1 of the microcontroller is an analog input of an analog digital converter, allowing the measurement of the voltage VC1 across the terminals of the monitoring capacitor. The first input I1 of a microcontroller may also be an analogue comparison input.

In a variant of this first embodiment, a second resistor R2 is also wired up in parallel with the monitoring capacitor C1 when a second controlled switch CT2 is closed. The control of this switch is effected via a second control terminal CT2, which is connected to the second output O2 of the microcontroller CPU.

A second embodiment of the power-off time monitoring unit TCU is represented in FIG. 3B. This embodiment differs from the first embodiment in that the unit comprises a comparator COMP whose two inputs are respectively enabled by a reference voltage signal REF and by the signal for the voltage across the terminals of the capacitor C1. The logic output of the comparator COMP is connected to the terminal VCM of the power-off time monitoring unit. The reference voltage REF is a fraction of the voltage +Vcc. The output of the comparator is in the high state when the voltage VC1 drops below REF. The measurement output VCM then gives a logic information regarding the situation of the voltage VC1 with respect to the comparison threshold constituted by the voltage VREF. In this case, the input I1 of the microcontroller is a logic input.

As in the first embodiment, a variant provides for a second resistor R2 to be likewise wired up in parallel with the monitoring capacitor C1 when a second controlled switch CT2 is closed.

It is noted that the position of the controlled switches is indicative. For example, the controlled switch CT1 may equally well be interposed between the grouping comprising the resistor R1 and the capacitor C1, on the one hand, and the ground GND, on the other hand, rather than between this grouping and the positive line VCC. One of the controlled switches CT1 or CT2, or both, may be included in the microcontroller. For example, if the second output O2 of the microcontroller is an open collector or open drain type with ground link, then the controlled switch CT2 becomes unnecessary and it suffices to establish between the resistor R2 and the second control terminal CC2 the connection represented by the dashed line DL.

Figure 4:
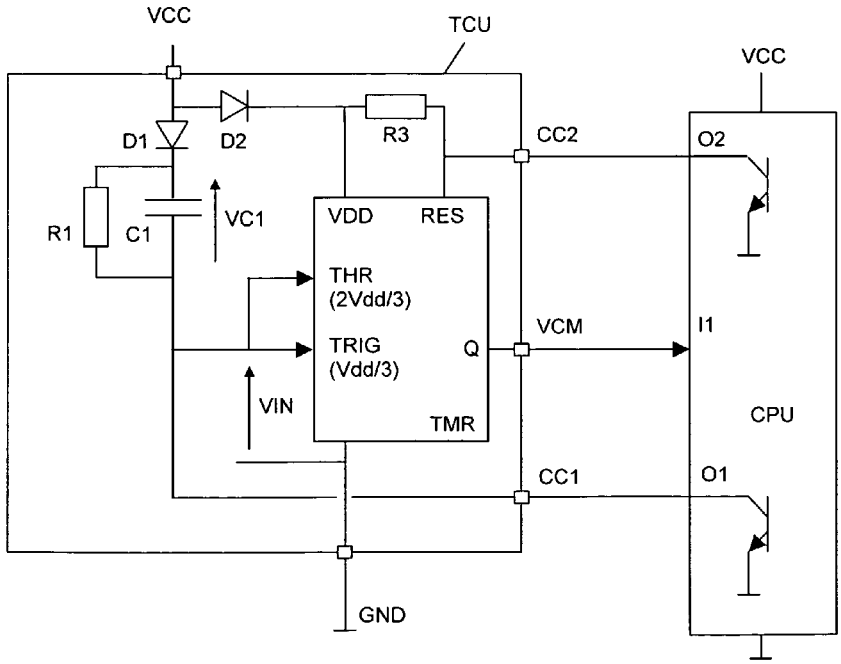

In a third embodiment of the power-off time monitoring unit, represented in FIG. 4, a double-comparator arrangement is used. These two comparators are here advantageously included in a timer circuit TMR of the 555 type, a cost-effective circuit that is very well known to any electronic engineer and is used in a novel way for the implementation of the invention. The timer circuit TMR is for example, the TLC555 circuit from Texas Instruments (registered trademark).

FIG. 4 also partially represents the microcontroller. It is assumed that the outputs represented of the microcontroller are of the open collector type, and that its input represented is of the logic type. It is also assumed for simplicity that the diodes used are perfectly conducting in their direction of conduction as are the output transistors included in the microcontroller.

The timer circuit TMR is used here neither in a timer, or monostable, mode nor in an oscillator, or astable mode.

This circuit is powered, through a diode D2, between terminals GND and VDD under a voltage +Vdd, which is equal to +Vcc when the line VCC is powered.

This circuit comprises a triggering input TRIG which is compared, internally, with a calibrated voltage REF1, equal to a third of the supply voltage: REF1=+Vdd/3. This circuit also comprises a threshold input THR which is compared, internally, with a calibrated voltage REF2, equal to two thirds of its supply voltage: REF2=+2Vdd/3.

A third input RES for resetting the circuit TMR to zero is normally placed at the potential +Vdd through a protective resistive R3 and a diode D2. When this input is brought to the low state, the output Q of a flip-flop integrated with the timer circuit TMR enters the low state. The diodes D1 and D2 serve to prevent any reverse current due to the specific behavior of the inputs or outputs of certain integrated circuits when the latter are no longer powered.

The voltage +Vdd is equal to the voltage +Vcc when there is no interruption to the voltage of the AC mains. The voltage VIN is taken as the complement of the voltage VC1 (VIN=Vcc−VC1), hence VIN increases from 0 to +Vcc when the monitoring capacitor C1 discharges through the resistor R1.

Figure 9:
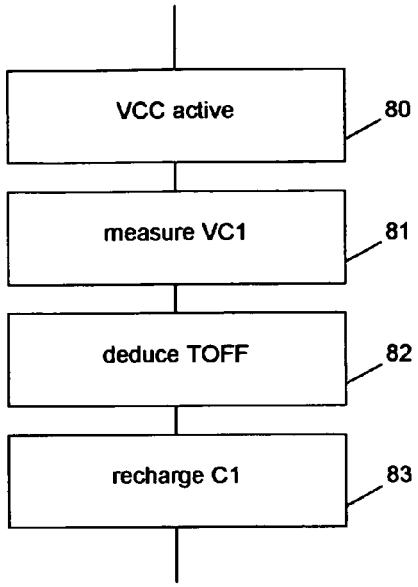
FIGS. 9 and 10 are flowcharts of two variants of execution of the method according to the invention.

A first mode of execution of the method of estimating the duration for which the actuator is not powered is described with reference to FIG. 9. Such a method may in particular be implemented by the actuator described previously.

In a first step 80, the power supply to the actuator is detected by the presence of the voltage +Vcc on the line VCC powering the supply terminal of the microcontroller CPU. Thus, after a period of inactivity during which the actuator was no longer powered, the appearance of the voltage +Vcc wakes up the microcontroller CPU.

In a second step 81, the voltage VC1 across the terminals of the monitoring capacitor C1 is measured. It is not essential in the course of the voltage measuring step 81 to carry out a complete measurement of the voltage across the terminals of the monitoring capacitor: instead, it suffices to gather an information regarding this measurement, for example by comparison with a predetermined voltage threshold.

In a third step 82, an indication regarding the duration for which the actuator was no longer powered is deduced from the above voltage value, which duration preceded the step 80 of detecting the presence of voltage on the positive line VCC.

During step 82, the duration TOFF of cutout of the power supply is therefore deduced from the information gathered during the voltage measurement step 81. Once again, it is not necessarily a matter of accurately determining the value of the duration TOFF. A single predetermined value TMIN constituting a lower bound to the duration TOFF or a single predetermined value TMAX constituting an upper bound to the duration TOFF may suffice. Likewise, a fortiori, two predetermined values TMIN and TMAX bracketing the duration TOFF may suffice.

During a fourth step 83, the monitoring capacitor C1 is recharged, for example by closing the controlled switch C1. The switch is maintained in its state in such a way that the latter remains charged under a predetermined voltage as long as the actuator is powered. This fourth step could also come into play only when a signal heralding a cutout of the power supply is detected.

Under the assumption that a power-off time monitoring unit TCU such as that represented in FIG. 3B is used to implement the method, the time charts of the voltage delivered by the supply converter PSU and of the voltage VC1 across the terminals of the monitoring capacitor are represented in FIGS. 5 to 7. It is also assumed that the voltage comparison threshold VT1 is here equal to +Vcc/3 and that the horizontal time axis cuts the vertical voltage axis at a voltage value of zero.

Figure 5A:
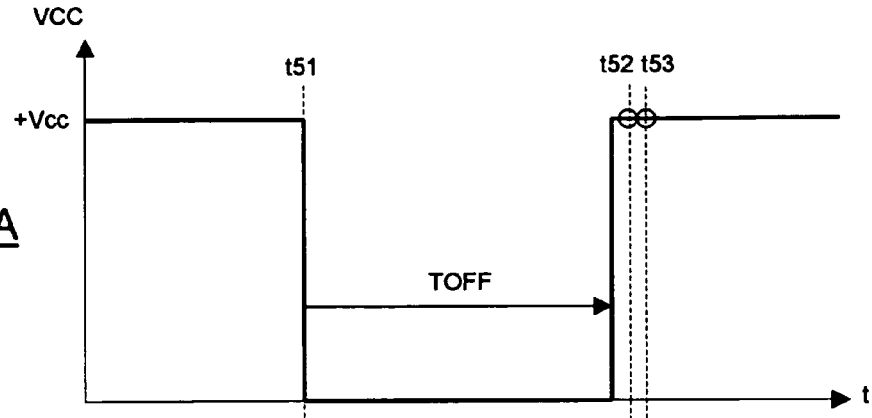

In FIG. 5A, an interruption to the supply voltage causes the zeroing of the voltage +Vcc on the line VCC at an instant t51. It is assumed for simplicity that the decay is abrupt. The supply voltage reappears after a duration TOFF to be quantified.

Figure 5B:
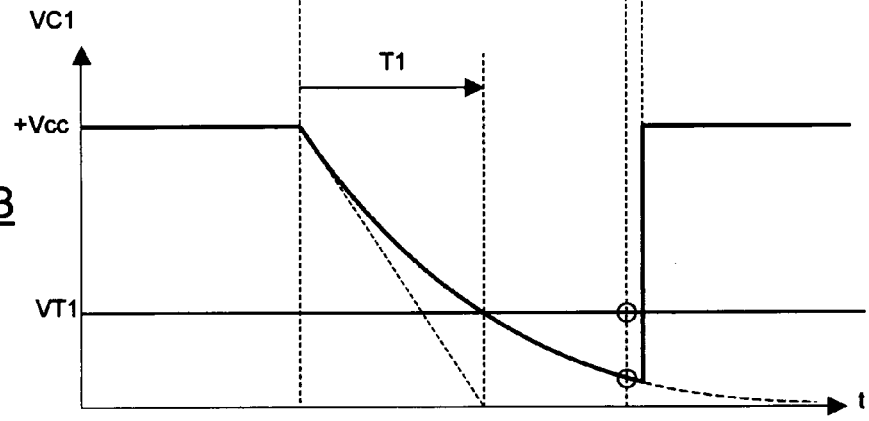

In FIG. 5B associated with the same events, the monitoring capacitor C1 is charged permanently under the voltage +Vcc as long the positive line VCC is powered. After the instant t51, it discharges into R1 with a time constant R1×C1. After a duration T1, the voltage VC1 becomes less than the threshold VT1 and the monitoring capacitor C1 continues to discharge. As the threshold VT1 is here equal to a third of the initial voltage, the duration T1 corresponds approximately to a time constant R1×C1. The choice of a time constant close or equal to the duration of comparison gives good accuracy of measurement.

After a duration TOFF, the actuator is again powered and the voltage +Vcc is reestablished. The microcontroller is therefore woken up. It proceeds to implement the method, described above, which has been represented, with a very exaggerated delay, at the instant t52. Likewise, the comparator COMP is powered again and provides a valid indication on its output. At this instant the microcontroller reads the state of its first input I1 which is connected to the output of the comparator COMP. In the case of the embodiment of FIG. 3A, it reads the value of the voltage VC1 directly. This operation is symbolized by the small circles relating to the instant t52. In either case, the microcontroller determines whether the duration TOFF has or has not been greater than the duration T1, the response being positive in the example of FIG. 5B. In the case of a direct analog measurement of the voltage VC1, it is even possible to deduce an accurate value of TOFF (to within the wake up time of the microcontroller) from the known law for the exponential decay of the voltage. However, a very accurate value is of little benefit.

At the instant t53, the microcontroller activates its first output O1, thereby rendering the switch CT1 conducting. The monitoring capacitor C1 then charges almost instantaneously under the voltage +Vcc, the resistance of the capacitor charging circuit being very low. The first output O1 of the microcontroller remains permanently activated, it is deactivated only by the disappearance of the voltage +Vcc on the line VCC, and hence by the shutting down of the microcontroller. However, provision may also be made for the microcontroller to be furnished with a device warning of a power cutout in the line AC-H and for it to allow the activation followed by the deactivation of its first output O1 when such a cutout occurs.

Figure 6A:
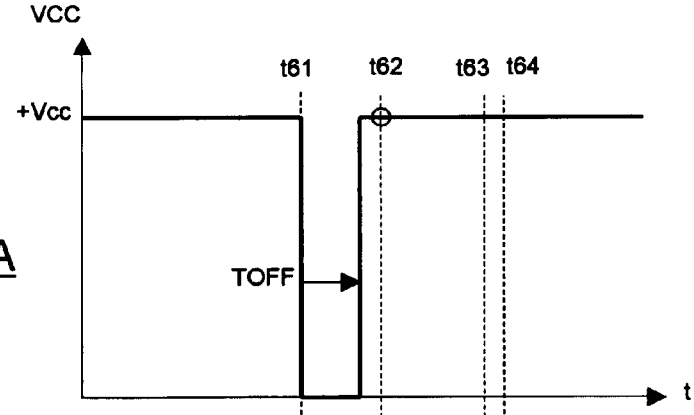
Figure 6B:
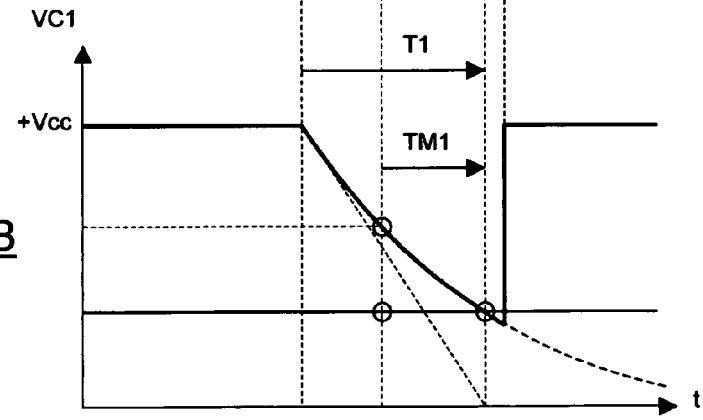

In the time charts of FIGS. 6A and 6B, the duration TOFF of interruption to the supply is shorter than the duration T1 corresponding to the overstepping of the threshold VT1 by the voltage VC1 across the terminals of the monitoring capacitor when the latter discharges.

The voltage +Vcc disappears at the instant t61 and reappears after the duration TOFF. Immediately afterwards, at the instant t62, the microcontroller reads: either directly the voltage VC1 across the terminals of the capacitor C1, or the state of the output of the comparator COMP. In the first case, it deduces the value of the duration TOFF directly therefrom and it can proceed to the next step of the method. In the second case, the microcontroller deduces that the duration TOFF is less than the duration T1, but without knowing its value.

In FIG. 6B, after the appearance of the actuator supply voltage, at an instant t62, the duration which elapses until, at the instant t63, the voltage VC1 across the terminals of the capacitor C1 becomes less than the voltage VT1 and until as a consequence, the logic output of the comparator COMP flips, is measured. This measurement may for example be implemented by using a time measuring circuit which may for example be included in the microcontroller. The microcontroller thereafter deduces the duration TOFF of the value TM1 measured and of the value T1 corresponding to the duration of discharging of the capacitor from the voltage +Vcc to the voltage VT1.

The duration T1 may have been prerecorded or may still be measured directly in a learning cycle during which the microcontroller itself brings about the discharging of the monitoring capacitor C1 by opening the controlled switch CT1.

A drawback of this procedure resides in its duration of execution: the shorter the duration TOFF that the cutout has had, the longer is the wait to quantify it.

FIGS. 7A to 7C represent the application of a variant of the method to the previous case of the cutout represented in FIG. 6A.

At an instant t72, the microcontroller is woken up by the appearance of a supply voltage for the actuator and it then reads the state of its first input I1 and can therefore determine that the duration TOFF is less than the duration T1. It thus activates its second output O2, thereby rendering the switch CT2 conducting and accelerating the discharging of the monitoring capacitor C1. The microcontroller measures the time elapsed TM2 until overstepping of the threshold VT1, at an instant t73.

The knowledge of the duration TM2 and its comparison with a value TM2MAX prerecorded or determined in a learning cycle makes it possible to determine whether the duration of the cutout TOFF was greater than a value TMIN such that TM2=TM2MAX if TOFF=TMIN.

Taking T1=TMAX, the value of the duration TOFF is therefore bracketed between two values TMIN and TMAX.

A variant which is simple for the person skilled in the art to implement also consists in using two comparison thresholds and hence a first comparator COMP1 and a second comparator COMP2 as replacement for the comparator COMP, on condition that it is possible to read, with the microcontroller, the state of each comparator.

A first threshold VT1 is chosen, for example equal to +Vcc/3 while a second threshold VT2 is chosen for example equal to +2Vcc/3. To these two thresholds there correspond the durations TMAX and TMIN, and it suffices for the second comparator COMP2 to be activated while the first is still not to deduce that the duration TOFF lies between the durations TMIN and TMAX. Such a method may be implemented by an actuator comprising a control unit MCU furnished with a power-off time monitoring unit TCU such as that described in FIG. 4. Internally, the result of the comparisons activates in this unit a flip-flop RS whose output Q is taken as measurement output terminal VCM.

If a voltage VIN measured on the circuit for charging the capacitor C1 between the ground and the capacitor C1 is applied simultaneously to both inputs TRIG and THR of the circuit TMR described above, the output Q of the circuit TMR is in the high state while the voltage VIN lies between 0 and +2Vdd/3 and then the output Q passes to the low state when the voltage VIN becomes greater than 2Vdd/3, the voltage increasing from 0 to +Vdd.

Conversely when the voltage VIN decreases from +Vdd to 0, the output Q is in the low state while the voltage VIN lies between +Vdd and +Vdd/3, and then passes to the high state when the voltage VIN passes below +Vdd/3.

FIG. 8 represents the changes in the output Q of the timer circuit TMR when the voltage VIN or the voltage VC1 change over time in a manner assumed to be linear. Also represented by dashes are the changes in the output Q that would occur for a reverse change (decrease in the voltage VIN).

Figure 10:
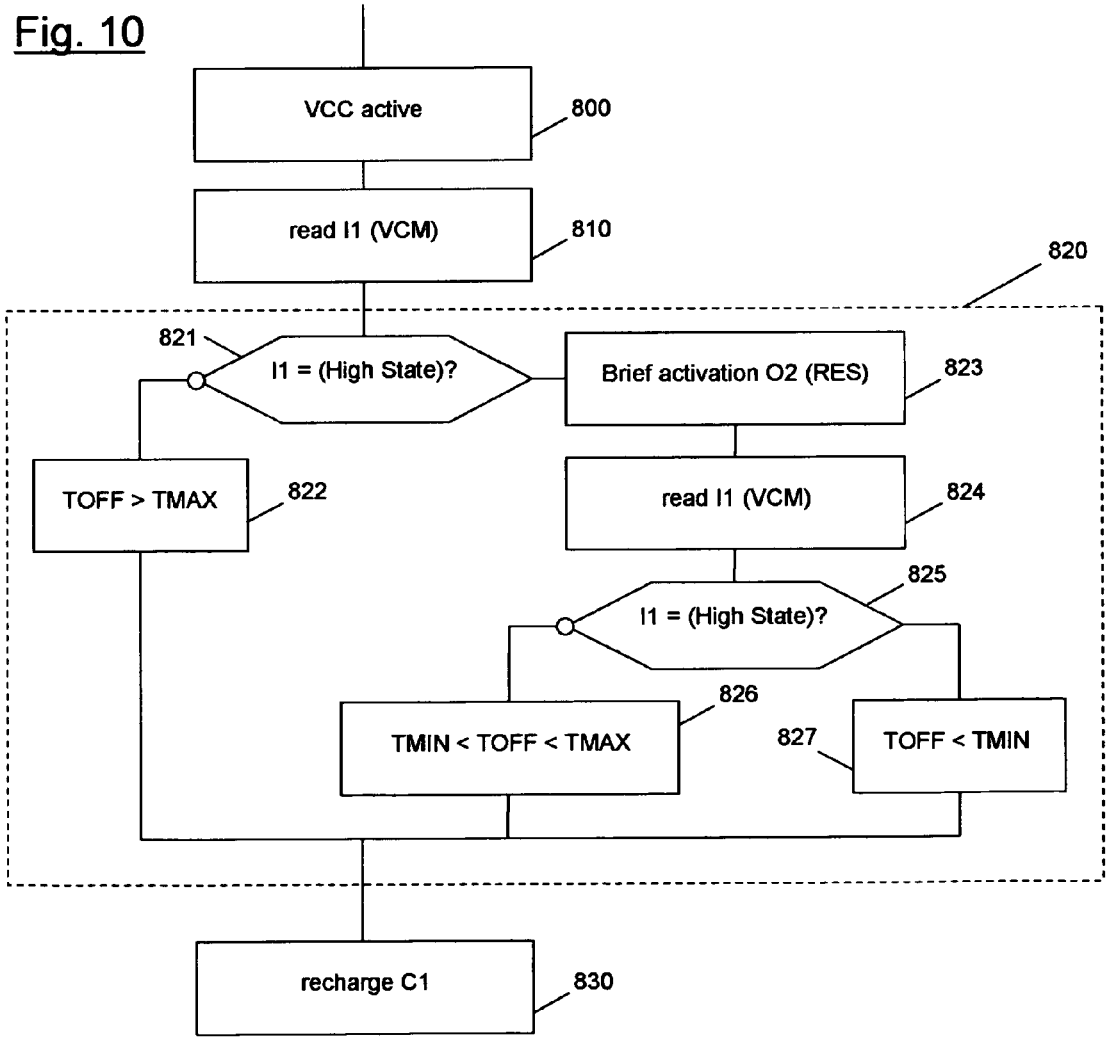

Another method of determining the duration TOFF for which the actuator comprising the circuit of FIG. 4 is not powered is represented by the flowchart of FIG. 10.

In a step 800, the power supplied to the actuator is detected by the presence of the voltage +Vcc on the line VCC powering the power supply terminal of the microcontroller CPU.

In a step 810, the microcontroller reads the state of its first input I1.

In a step 820, the microcontroller determines the duration TOFF. In a first test substep 821, we determine whether the input I1 is in the high state. If it is not, we go to a substep 822 in which it is determined that the cutout duration TOFF is greater than TMAX. Specifically, if the output Q of the circuit TMR is in the low state while the voltage VIN in is increasing, then the voltage VIN is greater than +2Vcc/3, hence the voltage VC1 is less than +Vcc/3. If the result of substep 821 is positive, there is indeterminacy. To remove this indeterminacy, during a substep 823 the second output O2 of the microcontroller is briefly activated, this having the effect of briefly causing the input RES of the timer circuit TMR to pass to the low state. The output Q of the internal flip-flop RS therefore passes to the low state during the activation of this reset-to-zero signal. The internal flip-flop RS retains this state if the voltage VIN lies between the two threshold values, on the other hand it reverts immediately to the high state if the voltage VIN is less than the first threshold +Vcc/3.

Thus, during a substep 824, a new reading of the first input I1 is carried out and its state is tested in a substep 825. Should it be a high state, then we go to a substep 827 in which the cutout duration TOFF is identified to be less than the duration TMIN. Otherwise, we go to a substep 828 in which the cutout duration TOFF is identified to lie between the durations TMIN and TMAX.

In all cases, we then go to a step 830 in which the first output O1 of the microcontroller is activated, this having the effect of allowing the charging of the monitoring capacitor C1.

The installation 1', represented in FIG. 2, differs from the installation described previously in that the motor MDC of the actuator is of the DC type.

This difference necessitates the replacement of the switching unit by a power unit PWU which rectifies the AC voltage of the AC mains and connects the motor MDC according to a first polarity or a second polarity so as to operate the equipment in a first direction or in a second direction. The detailed structure of such a power unit PWU is known to the person skilled in the art.

Specific embodiments of a actuator for operating a rolling shutter according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

The invention claimed is:

1. An actuator for operating a movable screen or a movable object for closure, shading or solar protection of a building, comprising:

at least two terminals for connecting the actuator to a voltage source;

an electric motor;

means of powering the motor from the voltage source;

a control unit connected to the means of powering the motor from the voltage source, the control unit comprising:

a voltage converter whose output powers a microcontroller driving the means of powering the motor, and a unit for monitoring the power-off time during which the actuator is not connected to the voltage source, the monitoring unit determining whether power-off time comprises a command.

2. The actuator as claimed in claim 1, wherein the unit for monitoring the power-off time comprises a monitoring capacitor, at least one resistor arranged in parallel with the capacitor, a switching means for controlling the charging and the discharging of the capacitor, and an output terminal giving an information regarding the voltage across the terminals of the capacitor.

3. The actuator as claimed in claim 2, wherein the power-off time monitoring unit comprises a comparator comparing the voltage across the terminals of the capacitor with a reference voltage and whose logic output is connected to the output terminal of the time monitoring unit.

4. The actuator as claimed in claim 2, which comprises a time measurement circuit.

5. A method for estimating a duration for which an actuator as claimed in claim 1 is not powered, which comprises:

charging a monitoring capacitor;

ceasing to power the actuator;

closing an electrical circuit for discharging the capacitor;

powering the actuator; and obtaining an information regarding the voltage across the terminals of the capacitor, deducing from this information, at least one limit of the interval in which the duration separating the event of ceasing to power the actuator from the event of powering the actuator is located, and determining whether the interval comprises a command.

6. The method as claimed in claim 5, wherein the information regarding the voltage across the terminals of the capacitor is the value of the voltage across the terminals of this capacitor.

7. The method as claimed in claim 5, wherein the information regarding the voltage across the terminals of the capacitor is a logic value resulting from a comparison of this voltage with a reference voltage.

8. The method as claimed in claim 5, wherein the information regarding the voltage across the terminals of the capacitor is a duration required to discharge the capacitor from its voltage down to a predetermined voltage.

9. The method as claimed in claim 5, wherein the actuator is powered from the AC electrical mains.

* * * * *